US005142295A

United States Patent [19]

Dourson

[11] Patent Number: 5,142,295

[45] Date of Patent: Aug. 25, 1992

[54] POWER ANTENNA WITH COMPACT DIRECT DRIVE SYSTEM

[75] Inventor: Stephen E. Dourson, Dayton, Ohio

[73] Assignee: General Motors Corporation, Detroit, Mich.

[21] Appl. No.: 728,487

[22] Filed: Jul. 11, 1991

[51] Int. Cl.[5] ..... H01Q 1/10

[52] U.S. Cl. ..... 343/903; 343/715

[58] Field of Search ..... 343/903, 900, 901, 711, 343/714, 715; 242/54 A

[56] References Cited

U.S. PATENT DOCUMENTS

| | | | |
|---|---|---|---|
| 2,838,953 | 6/1958 | Cone | 74/501 |
| 2,925,743 | 2/1960 | Wise | 343/903 |
| 3,017,780 | 1/1962 | Keinhofer | 74/95 |
| 4,153,825 | 5/1979 | Flora | 200/47 |
| 4,789,867 | 12/1988 | Lee | 343/903 |

OTHER PUBLICATIONS

Brochure from Zero-Max Industries published in 1982.

*Primary Examiner*—Michael C. Wimer
*Assistant Examiner*—Hoanganh Le
*Attorney, Agent, or Firm*—Patrick M. Griffin

[57] ABSTRACT

A compact direct drive system for an extensible and retractable antenna assembly uses a one-piece antenna and no threads or gears. The one-piece antenna is supported so as to slide axially up and down, but is restrained against turning. It runs through the hollow drive shaft of a coaxially supported electric motor. Traction rollers supported on skewed shafts fixed to the end of the drive shaft drive the antenna up and down.

3 Claims, 2 Drawing Sheets

POWER ANTENNA WITH COMPACT DIRECT DRIVE SYSTEM

This invention relates to extensible and retractable power driven antennas in general, and specifically to such an antenna that has a gearless, threadless direct drive system that is particularly compact.

BACKGROUND OF THE INVENTION

Power driven, extensible and retractable vehicle radio antennas generally incorporate telescoping hollow sections that are extended and retracted indirectly by a cable. The cable is wound from a reel that is powered by a motor and worm gear assembly. It is also known to push and pull the drive cable with friction rollers as it moves through a storage casing, rather than winding it on and off of a reel. Indirect drive of multipiece telescoping antennas presents a problem in that the cable is put in compression when raising the antenna. As in attempting to push on a string, there is a much lower compression resistance than tension. Extensible and retractable one-piece antennas are also known, which are inherently simpler and durable. These are generally pulled out and pushed back manually into a storage casing located inside a body panel, such as a roof pillar. A manually stowed antenna is, of course, difficult to operate from the interior of a vehicle, especially in motion.

SUMMARY OF THE INVENTION

The invention provides a system for power driving such a one-piece antenna that is direct, threadless, gearless and especially compact.

In the embodiment disclosed, the antenna itself is a cylindrical rod that is fairly stiff, but still flexible enough to be stowed in other than a perfectly straight configuration. The antenna slides axially up and down freely with a guide tube, between a raised position above a vehicle body panel and a stored position beneath. The antenna is constrained against radial turning within the guide tube by interfitting fins and slots. Just above the end of the guide tube, but below the vehicle body panel, is a reversible electric motor body with a hollow, cylindrical drive shaft. The drive shaft surrounds the antenna, without directly touching it, and is supported by the motor so as to revolve around the axis of the antenna, powered by the motor, without moving axially. Journaled to the end of the drive shaft are three threadless traction rollers, the axes of which are all skewed slightly. The traction rollers make direct contact with the outer surface of the antenna, but the engagement is frictional only, with no gear teeth or threads.

When the motor is run in either direction, the contact between the skewed traction rollers and the radially constrained antenna creates a net axial thrust on the antenna that sends it up or down. The system is simple and durable, since it has a one-piece antenna and no threads or gear teeth to wear or slip. Components are minimized in that the hollow motor drive shaft also serves as a carrier for the traction rollers, and helps to sheath the antenna as well. The arrangement is particularly compact in that the antenna runs right through the center of the motor and drive shaft.

It is, therefore, an object of the invention to provide a system for direct power driving a one-piece antenna.

It is another object of the invention to provide such a system that works without threads or gear teeth.

It is another object of the invention to provide such a system that minimizes the number of components.

It is still another object of the invention to provide such a drive system that is made particularly compact by running the antenna centrally through the hollow drive shaft of a motor.

DESCRIPTION OF THE PREFERRED EMBODIMENT

These and other objects and features of the invention will appear from the following written description, and from the drawings, in which.

Figure 1:
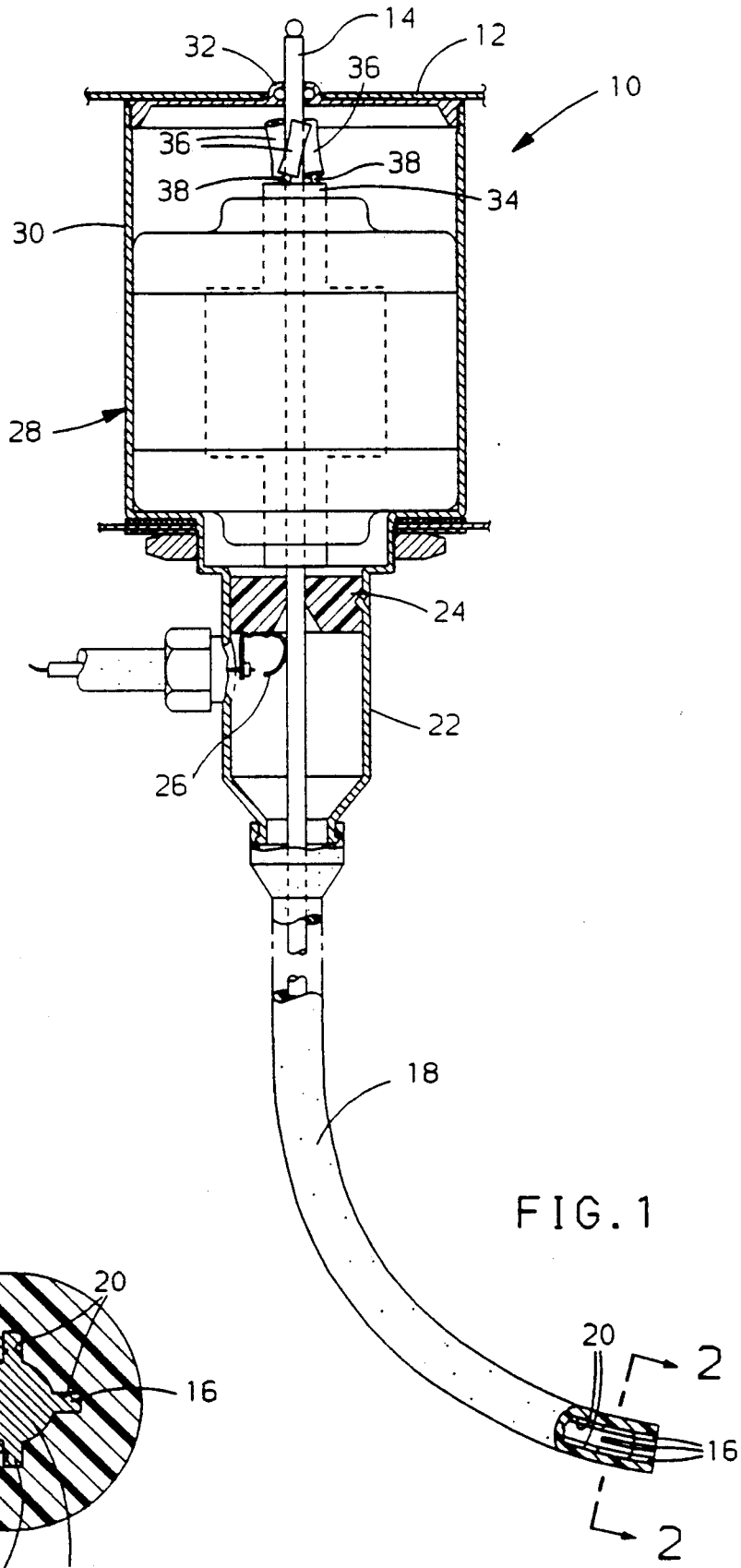
FIG. 1 is a view of a preferred embodiment of the invention showing part of the guide tube in cross section and showing the motor in elevation.
Figure 2:
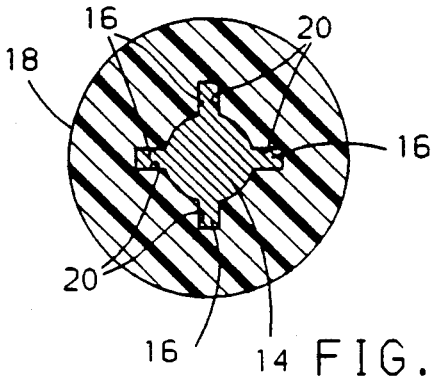
FIG. 2 is a cross section taken along the line 2—2 of FIG. 1.

Referring first to FIGS. 1 and 2, a preferred embodiment of the power operated antenna assembly of the invention, indicated generally at 10, is mounted beneath a vehicle body panel 12. The central component of the invention is a one-piece antenna 14, which is a flexible but tough stainless steel rod with a cylindrical outer surface and substantially constant cross section. At the lower end, however, antenna 14 has a set of four axial fins 16. Antenna 14 is slidably supported within a plastic guide tube 18, and is almost completely encased thereby. Antenna 14 is flexible enough that it can be stored in a curved condition, as illustrated. As it slides, antenna 14 is guided at the lower end by the fins 16, which ride in matching grooves 20 on the inside of tube 18, as best seen in FIG. 2. At the upper end of tube 18 an enlarged neck 22 contains a guide bushing 24 and an RF contact 26 that maintains itself in rubbing engagement with antenna 14 as it moves between extended and retracted positions. In general then, antenna 14 is well supported and guided for free sliding along its central axis, but is radially restricted from turning within tube 18, for a reason described below.

Figure 3:
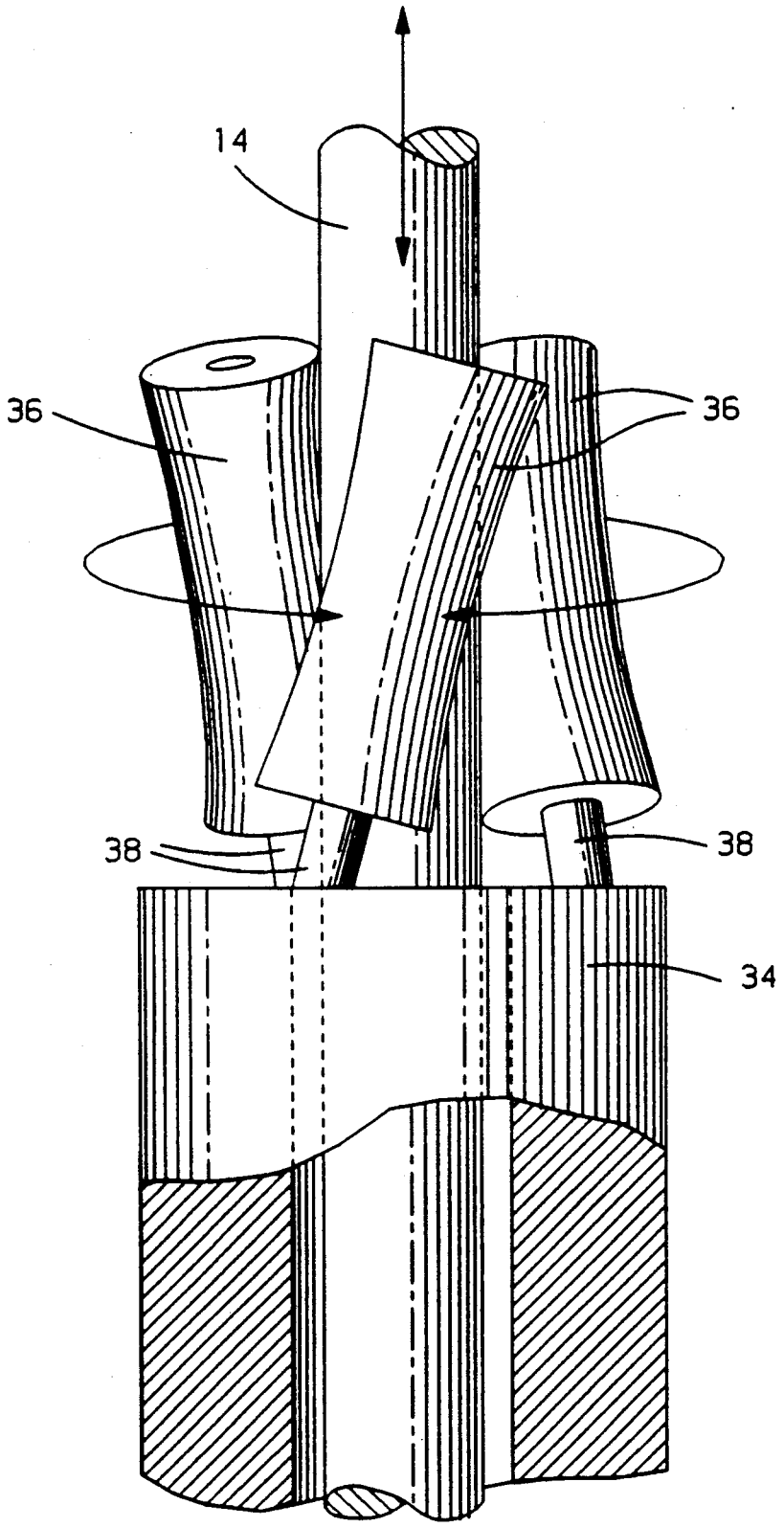
FIG. 3 is an enlarged view of just the top of the hollow drive shaft alone showing the operation of the traction rollers.

Referring next to FIGS. 1 and 3, the direct drive system that actually moves antenna 14 is illustrated. An electric motor, indicated generally at 28, includes a cylindrical housing 30 fixed just below panel 12, coaxial to guide tube 18 and just above neck 22. Antenna 14 passes entirely through motor housing 30, which incorporates a sealing ferrule 32 at the point where antenna 14 emerges from panel 12. This is possible because motor 28 also incorporates a special central drive shaft 34, best seen in FIG. 3. Unlike conventional solid shafts, drive shaft 34 is a short, hollow cylinder, through which antenna 14 extends with clearance. Shaft 34 is supported within housing 30 by its own bearings and revolves around antenna 14 as motor 28 operates, but does not move axially. Shaft 34 also carries three threadless traction rollers 36, each of which is supported for free spinning on its own axle 38. The axles 38 are deliberately supported so as to be skewed relative to the central axis of antenna 14, at an angle of about 15 degrees. The concave surface of each traction roller 36 approximates a hyperboloid, and is maintained in close contact with the cylindrical outer surface of antenna 14. Mutual contact is maintained either by the resilience of the axles 38 themselves, or by some separate springs or bands, not illustrated, that would pull the rollers 36 continually radially inwardly.

Referring next to FIG. 1, the operation of the invention is illustrated. When motor 28 is energized in one direction or the other, which would occur when the radio was turned on or off, its shaft 34 spins like any other solid motor shaft. For example, when the radio was turned on, motor 28 would turn shaft 34 counterclockwise, as seen from a perspective looking down antenna 14. If antenna 14 were not radially restrained, then the traction rollers 36 would simply revolve and carry antenna 14 with them, spinning it freely about its own central axis. An analogy would be a nut on a threaded rod. If one turns the nut and the rod is not radially restrained, then the two just turn together, with no relative axial motion. However, since the fins 16 and grooves 20 prevent antenna 14 from rotating, there is a net axial force created. Given their shape and the direction in which their axes are skewed away from the central axis of antenna 14, the traction rollers 36 tend to thread their way down the surface of the radially restrained antenna 14, but cannot, because drive shaft 34 is axially confined within motor housing 30. Instead, antenna 14 is pushed axially up, and raised above body panel 12 to the extended position. Conventional limit switches, not illustrated, would turn motor 28 off when antenna 14 was fully extended. The opposite would occur when the radio was turned off, with motor drive shaft 34 spinning clockwise and antenna 14 lowering and retracting.

The system described is particularly simple and robust, because of the lack of gears or threads to slip or wear. Any slippage between the outer surface of antenna 14 and the surface of the traction rollers 36 would not damage anything, unlike the case of slipped teeth or gears. The guide tube 18, neck 22, and drive shaft 34, being serially arranged, cooperate to form a complete sheath for antenna 14. The package disclosed is especially compact, because of the fact that all components closely surround the central axis of antenna 14. No motors, gears, or wheels are packaged far off to the side, as is the case with most conventional packages. Variations of the disclosed embodiment could be made. Some other means to power the hollow drive shaft 34 could be provided, instead of having it be an integral part of an electric motor 28.

The same basic driving action of the antenna 14 would occur, and the hollow shaft 34 would still provide both power and antenna sheathing in a compact and efficient manner. It is that much more efficient in terms of space and component reduction to incorporate the drive shaft right in motor 28, however. Another means to constrain the antenna 14 against turning could be used. For example, the guide tube could be an internal, stiff splined rod, over which an internally splined one-piece antenna was fitted to slide up and down. The antenna would likely have to be a larger diameter rod, in that case. Therefore, it will be understood that it is not intended to limit the invention to just the embodiment disclosed.

The embodiments of the invention in which an exclusive property or privilege is claimed are defined as follows:

1. An extensible and retractable power operated antenna assembly with a compact direct drive system, comprising, a one-piece cylindrical antenna having a central axis and supported for free axial sliding up and down about said central axis, but radially restrained against turning about said axis, a generally cylindrical hollow drive shaft coaxially surrounding said antenna and supported so as to revolve freely about the central axis of said antenna and drive shaft but constrained against relative axial sliding, a plurality of skewed threadless traction rollers supported on said drive shaft for free rotation about their axes and maintained in direct operative engagement with the outer surface of said antenna so that revolution of said drive shaft in either direction causes a net reaction force between said rollers and radially constrained antenna tending to drive said antenna in either axial direction through said hollow drive shaft, and, means for revolving said drive shaft.

2. An extensible and retractable power operated antenna assembly with a compact direct drive system, comprising, a one-piece cylindrical antenna having a central axis and a cylindrical outer surface, a coaxial guide tube within which said antenna is supported for free axial sliding but constrained against relative radial turning, a generally cylindrical hollow drive shaft aligned with said guide tube and coaxially surrounding said antenna, said drive shaft being supported so as to revolve freely about the central axis of said antenna and drive shaft but constrained against relative axial sliding, a plurality of skewed threadless traction rollers supported on said drive shaft for free rotation about their axes and maintained in direct operative engagement with the outer surface of said antenna so that revolution of said drive shaft in either direction causes a net reaction force between said rollers and radially constrained antenna tending to drive said antenna in either axial direction through said guide tube and through said hollow drive shaft, and, means for revolving said drive shaft.

3. An extensible and retractable power operated antenna assembly with a compact direct drive system, comprising, a one-piece cylindrical antenna having a central axis and a cylindrical outer surface, a coaxial guide tube within which said antenna is supported for free axial sliding but constrained against relative radial turning, an electric motor having a cylindrical housing arranged coaxial to said antenna, a generally cylindrical hollow motor drive shaft supported within said motor housing so as to revolve freely about the central axis of said antenna and drive shaft but constrained against relative axial sliding, and, a plurality of skewed threadless traction rollers supported on said drive shaft for free rotation about their axes and maintained in direct operative engagement with the outer surface of said antenna such that revolution of said drive shaft by said motor in either direction causes a net reaction force between said rollers and radially constrained antenna tending to drive said antenna in either axial direction through said guide tube and through said hollow drive shaft.

* * * * *